US006798322B2

(12) United States Patent
Copper et al.

(10) Patent No.: US 6,798,322 B2
(45) Date of Patent: Sep. 28, 2004

(54) LOW NOISE RELAY

(75) Inventors: Charles D. Copper, Harrisburg, PA (US); Charles D. Fry, New Bloomfield, PA (US); Henry O. Herrmann, Jr., Elizabethtown, PA (US); Robert D. Irlbeck, Greensboro, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/411,939

(22) Filed: Apr. 11, 2003

(65) Prior Publication Data

US 2003/0231090 A1 Dec. 18, 2003

Related U.S. Application Data

(60) Provisional application No. 60/389,732, filed on Jun. 17, 2002.

(51) Int. Cl.[7] ..... H01H 67/02; H01H 3/60

(52) U.S. Cl. ..... 335/128; 335/193

(58) Field of Search ..... 335/46, 78, 109, 335/128, 193, 202, 203, 146, 148, 247, 257, 271, 277, 280

(56) References Cited

U.S. PATENT DOCUMENTS

| | | | | |
|---|---|---|---|---|
| 3,164,758 A | * | 1/1965 | Siefert | 335/271 |
| 4,064,470 A | | 12/1977 | Hayden | 335/196 |
| 4,460,881 A | * | 7/1984 | Meister et al. | 335/128 |
| 4,739,293 A | | 4/1988 | Hurley et al. | 335/132 |
| 4,761,627 A | | 8/1988 | Bell | 335/128 |
| 5,083,104 A | | 1/1992 | Bassino | 335/128 |
| 5,151,675 A | | 9/1992 | Biehl et al. | 335/78 |
| 5,243,313 A | | 9/1993 | Basnett | 335/247 |
| 5,781,089 A | | 7/1998 | Doneghue | 335/78 |
| 5,949,313 A | | 9/1999 | Aoki et al. | 335/78 |

* cited by examiner

*Primary Examiner*—James R. Scott

(57) ABSTRACT

In order to reduce acoustic noise, an electromagnetic relay (2) includes an insert or bump (20) located between the relay armature (4) and the relay core (8). The insert is flexible and can be mounted on the armature. The insert (20) reduces noise by decelerating the armature (4) at impact with the core (8). The armature (4) can be tilted relative to a surface of the core (8) so that the insert or bump (20) can be positioned away from the primary impact between the core and the armature.

20 Claims, 6 Drawing Sheets

FIG 6
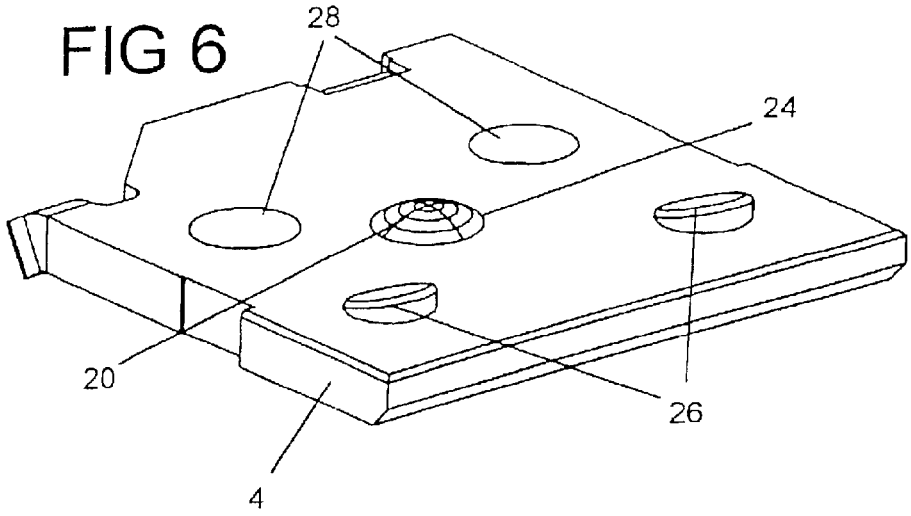
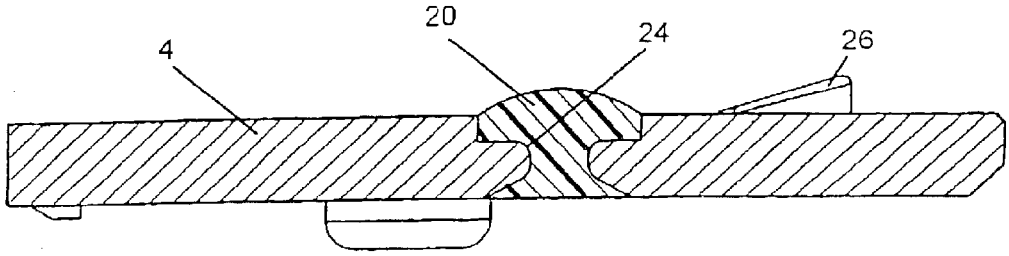
FIG 7

LOW NOISE RELAY

CROSS REFERENCE TO RELATED APPLICATIONS

The application claims the benefit of co-pending Provisional Patent Application Ser. No. 60/389,732, filed Jun. 17, 2002.

BACKGROUND OF THE INVENTION

1. Field of the Invention

To reduce acoustic noise during mating and unmating, an electromagnetic relay includes a nonmagnetic protrusion on the armature. This protrusion engages the core of the relay as the armature also engages the core to reduce the noise due to the collision of the armature with the core.

2. Description of the Prior Art

FIG. 1 is an exploded view of a prior art relay. FIG. 2 is a view, absent the relay cover, showing the assembled components of this prior art relay. Although reliable and effective from an electrical and mechanical perspective, the noise emitted by this relay during mating and unmating can be objectionable when used in certain applications. For example, a relay of this type, as well a comparable relays used for similar applications, can generate an audible noise, when used in proximity to a passenger compartment of an automobile. Extensive steps have been taken to reduce the noise in the passenger compartment, especially in luxury automobiles, and conventional relays used in this environment are considered to be an significant source of unwanted noise.

The prior art relay shown in FIG. 1 includes a movable contact mounted on a movable spring. The spring holds the movable contact in engagement with a normally closed contact until an increase in coil current generates a magnetic force above a pull-in threshold. The armature, which is attached to the spring then is attracted to the coil core, and the collision between the armature and the coil core results in an audible sound, which can be magnified due to resonance caused by the cover or other parts of the relay housing. Noise during drop-out occurs when the magnetic force is reduced so that the spring urges the movable contact into engagement again with the normally closed contact. This collision with the normally closed contact can also result in an objectionable noise, even thought the relay has properly performed its switching function.

FIG. 8 is a partial subassembly including an armature 40 and a spring 42 that is used in another prior art relay. A relatively soft die cut plastic or rubber pad 44 has been positioned between the armature 40 and the spring 42. Although the specific purpose of this pad 44 is not known, it may tend to reduce the audible noise which may otherwise occur during pull-in and/or drop-out. However, inclusion of this pad 44 between the armature 40 and spring 42 can significantly complicate fabrication of this subassembly.

SUMMARY OF THE INVENTION

An electromagnetic relay according to this invention includes a magnetic subassembly including a coil surrounding a core. The relay also includes an armature with a contact movable upon the application of a magnetic force when an electrical current in the coil attracts the armature into engagement with the core. A spring biases the armature so that the contact moves in an opposite direction upon separation of the armature from the core when the electrical current in the coil dissipates resulting in dissipation of the magnetic force. A nonmagnetic insert is positioned on the armature to engage the magnetic subassembly when the armature is in engagement with the core or just prior to engagement.

In such an electromagnetic relay, the nonmagnetic insert could be located on either the armature or the magnetic subassembly and in engagement with both the magnetic subassembly and the armature when the magnetic force attracts the armature into engagement with the core with the armature inclined relative to the core. An electromagnetic relay in accordance with this invention exhibits low acoustic noise characteristics upon engagement and disengagement of relay contacts, and the insert comprises means for reducing acoustic noise.

BRIEF DESCRIPTION OF THE DRAWINGS

FIG. 6 is a view of the armature of the preferred embodiment of this invention.

FIG. 7 is a sectional view showing a rubber bump protruding from an inner surface of an electromagnetic relay armature in accordance with the preferred embodiment of this invention.

DETAILED DESCRIPTION OF THE PREFERRED EMBODIMENT

Figure 1:
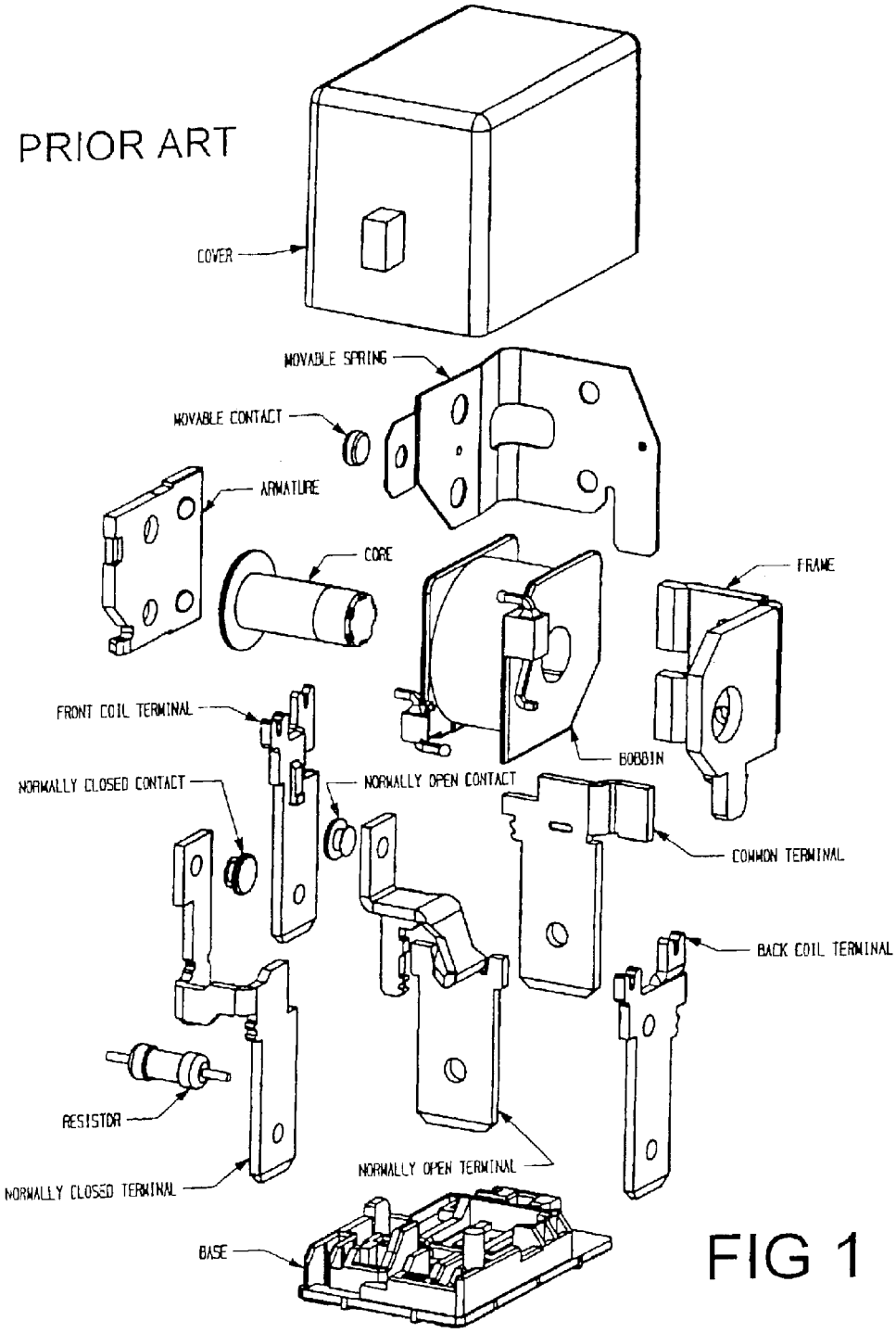
FIG. 1 is an exploded view of a prior art electromagnetic relay, which does not employ the low noise features of the instant invention.

An electromagnetic relay 2 in accordance with this invention includes a nonmagnetic protrusion 20 positioned between the relay armature 4 and the relay magnetic subassembly which can include the relay coil or winding 10, the relay core 8 and the relay bobbin 22. This protrusion is positioned so as to reduce the acoustic noise primarily created during pull in of the relay as the armature 4 strikes the relay core 8. This configuration also reduces acoustic noise during relay drop out, which can be due to collision between the movable contact 12 and the normally closed contact 14. This configuration thus reduces objectionable acoustic noise at it source. Since acoustic noise can be magnified by resonance due to the relay structure, including the base, cover and frame, a reduction in the noise due to impact will be cumulative.

Reduction in acoustic noise can be achieved by using this invention on a variety of relays without significantly increasing the cost or complexity of the relay. A nonmagnetic insert, protrusion or bump 20 can be added to many types of electromagnetic relays without adversely affecting the operation of the relay. In order to demonstrate the use of the nonmagnetic protrusion or insert of this invention, its addition to the prior art relay shown in FIGS. 1 and 2 will be described, after first discussing the structure and function of this prior art relay.

Figure 2:
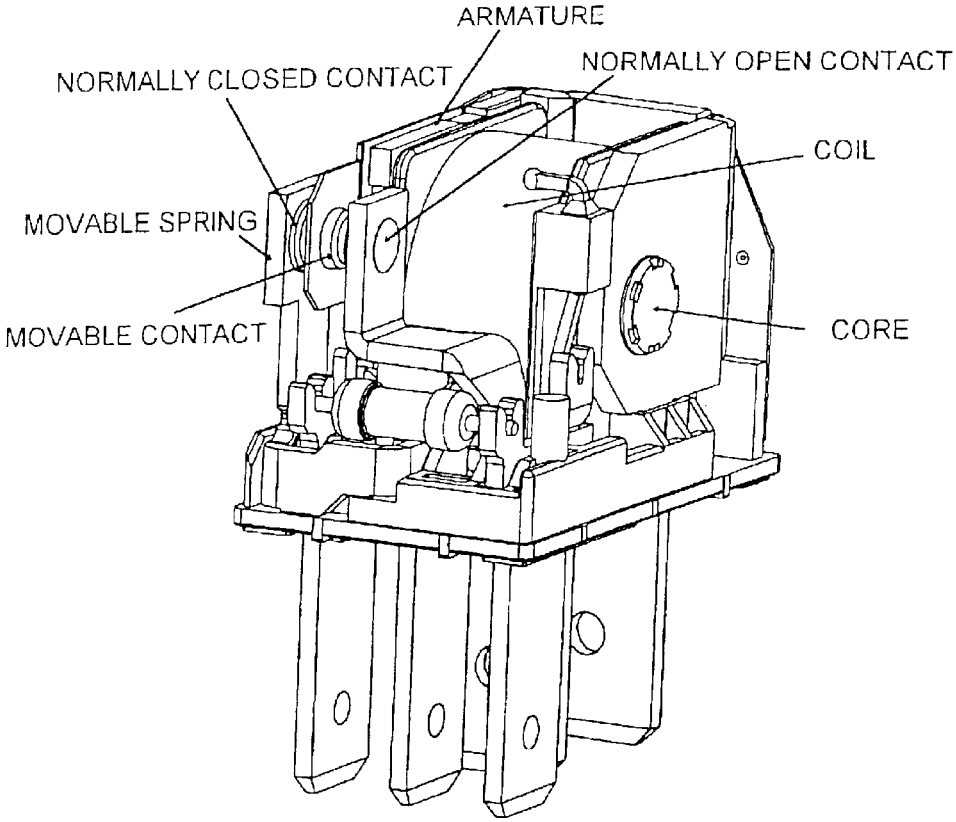
PRIOR ART FIG 2
FIG. 2 is a view, absent the relay cover, showing the assembled components of the prior relay shown in FIG. 1.

The prior art electromagnetic relay shown in FIGS. 1 and 2 is a conventional relay including both normally open and normally closed stationary contacts. A movable contact is shifted between the two stationary contacts by the presence or absence of a magnetic force generated by a current flowing through a coil or winding. An armature is moved into engagement with a core, extending through the coil or winding, when a current is applied to the coil to generate a pull in force. The armature is attached to a movable spring, and the electromagnetic force generated by the field established by current flowing through the coil must be sufficient to overcome a restoring force generated by the movable spring.

In the particular relay shown in FIGS. 1 and 2, the movable contact is mounted on the end of the movable spring. The portion of the movable spring on which the movable contact is mounted extends beyond the armature, which comprises a relatively rigid ferromagnetic member. The opposite end of the L-shaped movable spring is fixed to the frame, which also comprises a relatively rigid member. In this electromagnetic relay, a rear edge of the armature abuts an adjacent edge of the frame, and the movable spring extends around these abutting edges at least through a right angle so that the spring will generate a restoring force that will tend to move the armature away from the coil. In other words, when the movable spring is in a neutral, unstressed position, the armature will be spaced from the core.

Figure 5:
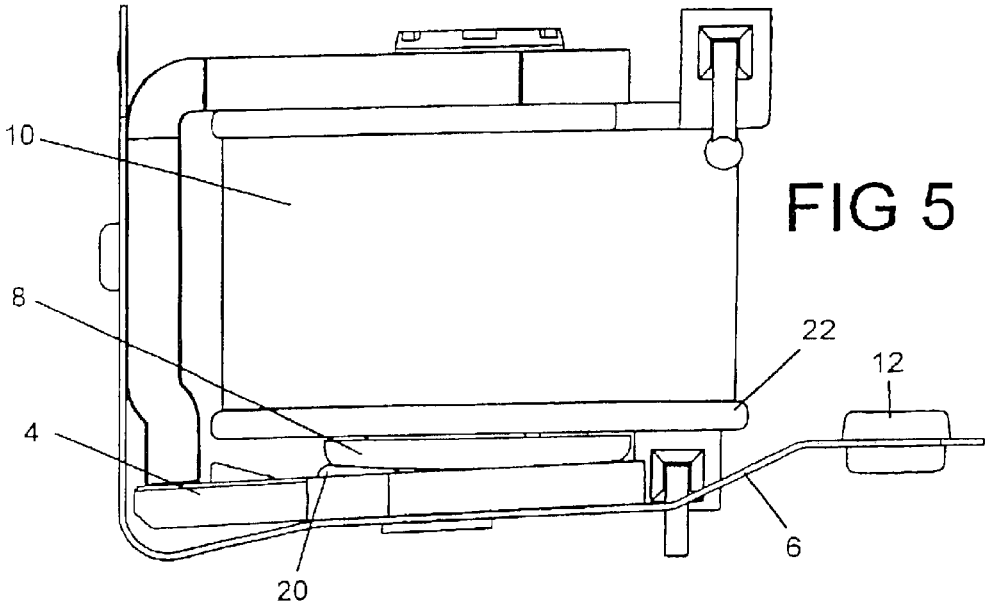
FIG. 5 shows the armature in the normally closed position with the armature and the nonmagnetic protrusion engaging the core.
Figure 8:
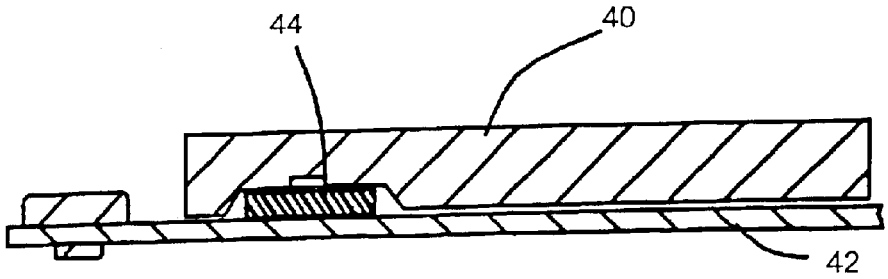
FIG 8 PRIOR ART
FIG. 8 is a partial view of the spring and armature subassembly used in a second prior art relay.

In the relay depicted in FIGS. 1 and 2 the armature is positioned so that when the armature engages the core, the armature will be tilted relative to the core. In other words, the abutting edge of the frame is laterally spaced beyond the exterior face of the core. This tilt or inclination is best seen in FIG. 5, which shows the armature 4 including the nonmagnetic insert 20. However, in the prior art relay, the armature is also inclined when in engagement with the core. This inclination or tilt insures that the armature and the core will engage at prescribed points to insure reliable operation within appropriate dimensional manufacturing tolerances.

It should be understood however, that a nonmagnetic insert in accordance with this invention can be employed on relays in which the precise orientation of the armature and the coil may differ from that depicted herein. For example, a nonmagnetic insert can be used on a relay in which the armature and the coil engage each other on flat, substantially parallel surfaces.

Direct contact or near direct contact between the armature and the core at the end of the pull-in switching operation is important to relay performance. Direct contact, so that only very small gaps exist between the armature and the core, provides a very large magnetic force, which essentially locks the two components together. High resistance to vibration and shock are primary benefits as is a low drop-out voltage, making the relay less sensitive to voltage variations after it has closed.

When a current flows through the relay coil or winding, the armature is magnetically attracted to the core. A sufficient force exerted by the electromagnetic field will overcome the force of the spring tending to keep the movable contact in engagement with the normally closed contact. As the armature moves into engagement with the core, the movable contact will first come into engagement with the normally open contact and current will flow between the movable contact and the normally open contact. Current will flow between the common terminal, attached to the movable spring, and the normally open terminal.

Overtravel of the spring is also desirable in order to maintain a continuous contact with sufficient normal force acting between the movable contact and the normally open contact. This overtravel is achieved in the prior art relay because most of the attractive force is generated by the action of the electromagnetic field on the armature, which is the largest movable mass. The overtravel is achieved by having the movable contact engage the normally open contact prior to engagement of the armature with the core. The further motion of the armature to reach its seated position on the core flexes the portion of the spring between the armature and the movable contact and generates a resilient force between the contacts. This will provide force on the contacts even if the contacts wear down or the terminals move away due to thermal expansion or for some other reason.

As the armature is drawn closer to the core by this electromagnetic force, the spring is flexed to transfer greater normal force to the mating contacts. Of course the greater the force acting on the armature, the greater will be the impact of the armature on the core and the movable contact on the normally open contact. The force generated by overtravel actually is directed against the seating motion of the armature to the core. As such, it actually helps reduce the velocity of the armature prior to its impact with the core. However, the force from overtravel directly contributes to drop-out noise, as although the force from the spring at the hinge point is acting to separate the contact in the absence of a magnetic field, the overtravel spring easily doubles the separation force during the short time when the contacts are still engaged.

The magnetic force on the armature increases almost exponentially as the gap between the core and the armature is reduced. Typically the magnetic force over much of the range of motion of the armature grows at a similar rate to the increase in the resisting spring force. However, during the second half of overtravel the magnetic force really sky rockets with respect to the spring force. A strong impact will generate more acoustic noise, but a larger attractive farce will also generate greater mating velocity, which will reduce the possibility of undesirable arcing during mating. A high mating velocity and a rapid build up of force ensures that the contacts have sufficient contact area during inrush current inherent to lamp loads to prevent contact overheating, melting and welding. Therefore, a large attractive force is desirable, even though it will result in more acoustic noise in a prior art relay, such as that shown herein, and for other prior art relay configurations as well.

The improved acoustic performance of electromagnetic relays incorporating this invention is premised upon the realization that a significant and noticeable contribution to acoustic noise is due to the noise generated by the armature in a relay of relatively standard design. The impact of the relay against the coil core causes an impulse that excites the relay structure during pull-in. During dropout, the armature will impact against the contact spring arm in some designs. In other designs, the contact impacts will be the source of noise during dropout. The possible impact with the spring is a result of prebias and is not related to stopping the opening motion of the armature. In all designs the armature must be stopped by some means.

The instant invention reduces acoustic noise generated by the armature by providing a gentle deceleration that eliminates or substantially reduces the stimulating impact. Deceleration can be achieved by positioning an insert at the point of impact between the armature and the coil core. However, in the embodiment depicted herein, it has been found to be more advantageous to position a protruding insert at a location spaced from the point of impact between the armature and the coil. This protruding insert will engage the armature just before the time that the armature engages the core, although admittedly the time period between the bump contact and the armature contact can be very short. This configuration therefore reduces or dampens the noise due to impact without resulting in a significant degradation in the pull in characteristics or the holding force maintaining the armature in intimate metallic contact with the core at the Ml pull-in position.

An insert that has a relatively small size in comparison to the armature can thus be used to achieve a significant noise reduction without adversely affecting the mating and unmating characteristics of the relay. A small nonmagnetic insert will result in only a small reduction of the magnetic material forming the armature. Replacement of a significant portion of the magnetic path with a nonmagnetic material would adversely affect the relay performance. Specifically, the pull-in voltage is increased by the replacement of magnetic by nonmagnetic material.

Figure 3:
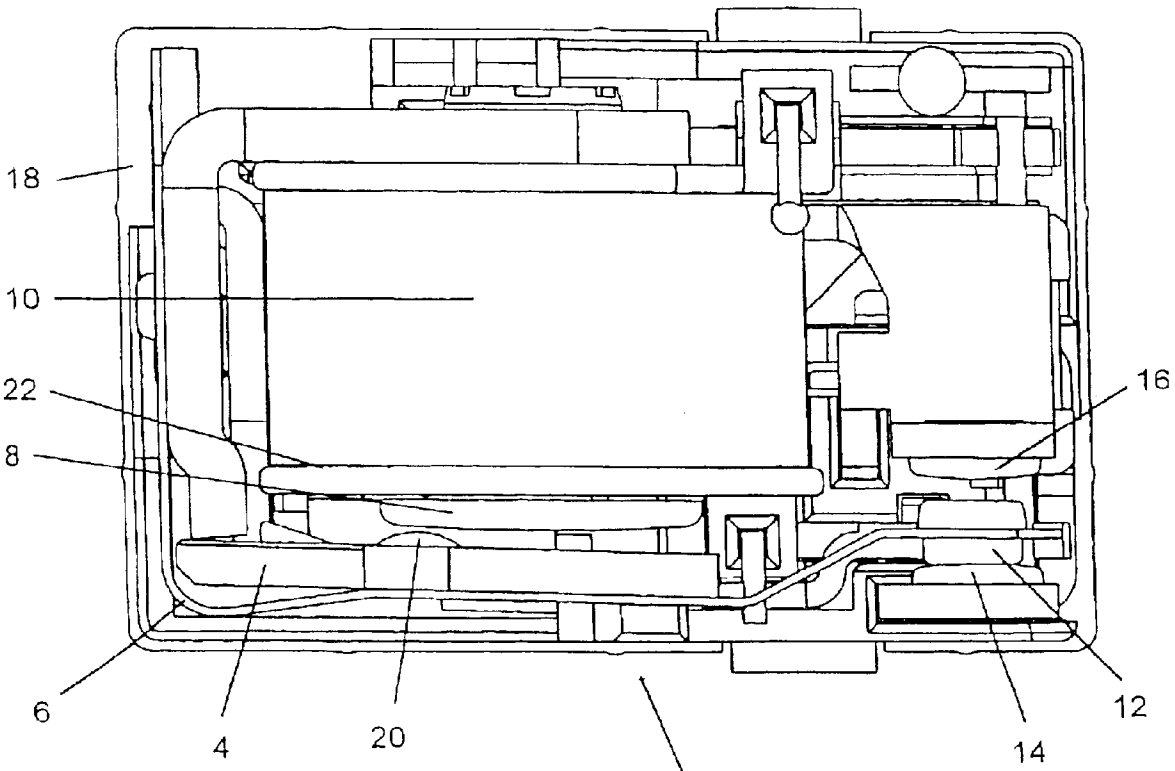
FIG. 3 is a top view of the internal components of the low noise relay assembly showing the armature and relay contacts in the normally open position.
Figure 4:
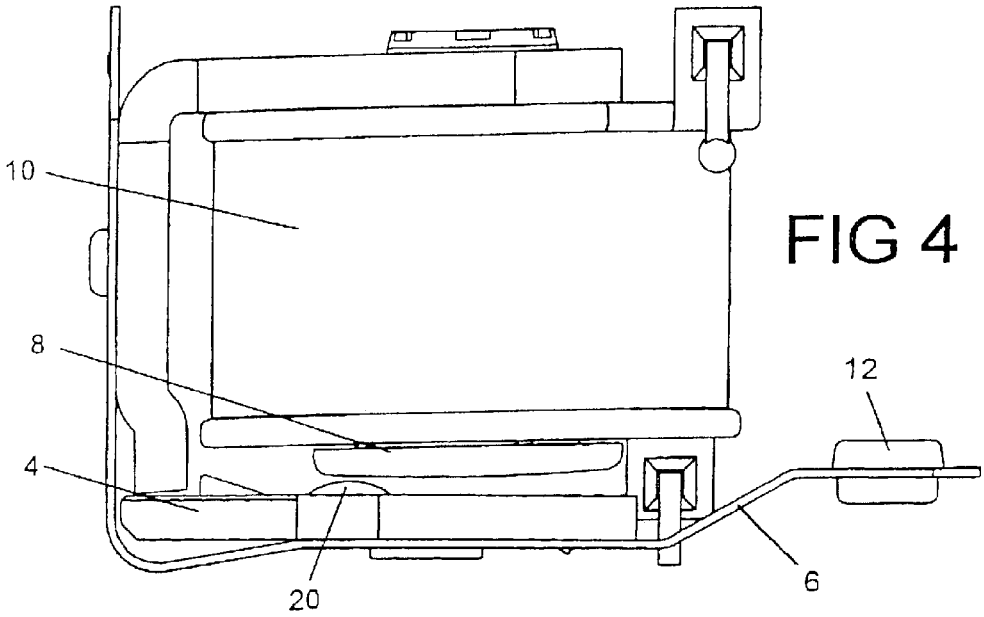
FIG. 4 is a top view similar to FIG. 3, but showing only a partial assembly including the frame, coil assembly, the armature and spring and the movable contact.

FIGS. 3–7 show a flexible nonmagnetic insert 20 mounted on an armature 4 in an otherwise conventional electromagnetic relay 2. The armature 4 is mounted on a resilient spring 6 that is attached to frame 16. The armature 4 and spring 6 form a subassembly that extends along two sides of a magnetic subassembly comprising a coil or winding 10, a bobbin 22, a core 8 and the frame 18. The movable contact 12 is mounted on the movable flexible spring between a normally closed contact 14 and a normally open contact 16. FIG. 3 shows the assembly in a position in which current cannot flow between the movable contact 12 and the normally open contact 16 with the armature 4 spaced from the core 8. In this position insufficient electromagnetic force exists to pull the armature 4 toward the core 8. A flexible nonmagnetic insert 20 protrudes from an interior face of the armature toward the core 8, but the insert 20 does not touch or engage the core 8 in this position. FIG. 4 is a partial assembly of components in the same position as shown in FIG. 3. The relay base, the contacts 14 and 16 are not shown so that the position of the insert 20 in relation to the armature 4 and the core 8 are more readily seen.

FIG. 5 shows the position of the armature 4 relative to the core 8 in the full pull-in position with the insert 20 engaging the core 8 at a position spaced from the point of primary contact between the armature 4 and the core 8. In this embodiment, the core 8 has a circular cross sectional shape and the point of primary contact between the armature 4 and the core 8 is along the periphery of the core 8 in the area furthest from the frame 18. The semispherical protruding insert 20 engages the core near its periphery at a location more proximate to the frame 18. The tilted or inclined position of the armature 4, relative to the core 8, is clearly shown. In the preferred embodiment the tilted orientation of the armature 4, which locally extends at an acute angle relative to the core 8, is not appreciably different from the orientation for a standard relay without the flexible insert 20. Since this insert 20 is flexible or resilient, the insert 20 will deform as the armature 4 strikes the core 8 and as the armature 4 is pulled toward the core 8 by the electromagnetic force generated by current flowing through coil 10.

FIGS. 6 and 7 show one means of positioning a flexible nonmetallic insert 20 in an armature 4. FIG. 6 shows an armature 4 with an opening 24 extending through the armature. This opening 24 is centrally located and an insert or bump 20 is located in this opening. Four other auxiliary openings, which would also be part of a conventional armature are also shown. Two of these openings 28 are for spin rivets. The other two are shock stops 26, designed to impact the frame if the relay were dropped in that specific axis. They will limit the resulting deflection of the spring so that no damage will occur. FIG. 7 shows an insert extending though an opening 24 between opposite sides of the metal armature 4.

Although the flexible insert 20 is mounted on the armature 4 in the representative embodiment depicted herein, it should be understood that the insert or bumper is merely located between the armature and the core. In the instant embodiment, the insert or bump protrudes from the surface of the armature and contacts the core in the gap formed by the angle between the armature and the core. Other configurations could be employed, including replacing a portion of the armature at the point of contact between the armature and the core, where the insert need not protrude significantly beyond the surface of the armature. The insert or bump could also be centrally mounted on the face of the core, instead of on the armature. A thin collar could be snapped around the perimeter of the core head. Other locations are possible, although they may involve tolerance problems. The insert or bump could act between the armature and the bobbin or some other component. However, the location of the bobbin or other component would have some variation relative to the core face, which controls the final resting location of the armature, and these locations are seen as less desirable, although permissible options.

The exact location, size, shape and durometer of the bump will control the extent and timing of deceleration during pull-in. A good combination will result in minimal deceleration during the initial force buildup on the normally open contact, followed by rapid deceleration just prior to impact. The resisting force offered by the insert or bump cannot be large enough to prevent the low amount of magnetic force present at the minimum required pull-in voltage from completely seating the armature on the core.

The extent of the tackiness of the material from which the insert or bump is formed will control the extent of the reduction in release velocity. If tackiness is employed, the degree of tackiness should be balanced to provide velocity—noise reduction without sacrificing too much drop-out velocity.

The bumper or insert can be manufactured in many ways. One possibility would be to dispense a flexible or resilient material onto the core or the armature, possibly using a stamped or formed feature to help control the size and shape of the bump by taking advantage of surface tension of the resilient material. In this version, the insert or bump need not extend between opposite sides of the armature, as illustrated by the representative embodiment. Another option would be to mold the material into the appropriate location, using an insert molding or overmolding or transfer molding operation. Another alternative would be to mold the insert or bumper as a separate piece and subsequently assemble the insert into a stamped and formed hole on the armature. The insert or bumper could be fabricated by extruding a continuous strip and then cutting the inserts to size with individual inserts being inserted into a stamped and formed hole.

Urethane is a potential material for use in creating a dispensable insert or bumper. Urethanes are rated to 155C., which may seem sufficient for a relay having a max relay ambient temperature of 125C. However, internal temperatures can be as high as 180C. during worst case conditions. Degradation of the urethane over time may result from these conditions. Initial experiments show that degradation does not impact relay performance, but the sound reduction capabilities are adversely affected or negated. Urethane becomes substantially harder at operating temperature of −30C., which might have deleterious effects on the performance of the relay. However, despite these drawbacks, urethane would appear to be a suitable material for noise reduction in some circumstances.

Silicone exhibits almost ideal hardness and temperature range characteristics for use in forming the insert or bumper. However, standard silicones are incompatible with relays because uncured material out gasses and redeposits on nearby surfaces. Heat from arcing can convert any uncured material, which has collected on contacts into glass and prevent the relay from conducting. However, special versions of silicone formulated to have extremely low out gassing or weight loss are available. Among these are formulations, which were developed for use in space where the combination of high temperatures and vacuum dramatically accelerate the out gassing phenomenon. These and other low volatility silicones, should be acceptable for use inside a relay, especially in the very small amounts needed to practice this invention. Other more traditional rubber materials, more suited for molding and extruding, would also be suitable for forming the insert or bump.

The insert or bump has been described as a nonmagnetic material, although that should be understood to be a relative term. The insert or bump is intended for reducing the noise during impact and will therefore generally not be a metallic material. However, a polymeric material having magnetic filler material might be suitable for use, in which case the term nonmagnetic material should be interpreted to mean relatively nonmagnetic.

Inasmuch as the single embodiment depicted herein has been specifically referred to as a representative embodiment, and because this invention is equally applicable to other standard relay configurations, and since a number of modifications have been discussed, it should be apparent that the invention is defined in terms of the following claims and is not limited to specific embodiments shown or discussed herein.

We claim:

1. An electromagnetic relay comprising:

a magnetic subassembly including a coil surrounding a core;

an armature;

a contact movable upon the application of a magnetic force when an electrical current in the coil attracts the armature into engagement with the core;

a spring biasing the armature so that the contact moves in an opposite direction upon separation of the armature from the core when the electrical current in the coil dissipates resulting in dissipation of the magnetic force;

wherein a nonmagnetic insert is positioned on the armature to engage the magnetic subassembly when the armature is also in engagement with the core.

2. The electromagnetic relay of claim 1 wherein the nonmagnetic insert comprises an insulative protrusion.

3. The electromagnetic relay of claim 1 wherein the nonmagnetic insert comprises a resilient protrusion.

4. The electromagnetic relay of claim 1 wherein the nonmagnetic insert comprises a deformable protrusion.

5. The electromagnetic relay of claim 1 wherein the nonmagnetic insert engages the core as the armature comes into engagement with the core.

6. The electromagnetic relay of claim 5 wherein the nonmagnetic insert and the armature engage the core at spaced locations on the core.

7. The electromagnetic relay of claim 6 wherein the armature is inclined relative to the core when in engagement with the core, such that the armature engages a defined point on the core, the nonmagnetic insert engaging the core at a second point opposite from the first point.

8. The electromagnetic relay of claim 1 wherein the nonmagnetic insert has a hemispherical shape.

9. The electromagnetic relay of claim 1 wherein the nonmagnetic insert is mounted in a hole extending through the armature and the nonmagnetic insert extends beyond one side of the armature.

10. The electromagnetic relay of claim 1 wherein the movable contact is mounted on the spring and the spring is attached to a rear face of the armature and wherein the nonmagnetic insert protrudes from a front face of the armature.

11. An electromagnetic relay exhibiting low acoustic noise characteristics upon engagement and disengagement of relay contacts, the electromagnetic relay comprising:

a magnetic subassembly including a core;

an armature attracted to the core by a magnetic force, movement of the armature into engagement with the core bringing the relay contacts into mutual engagement;

a spring acting to move the armature to a position in which the relay contacts are disengaged; and an insert in engagement with both the armature and the magnetic subassembly when the armature is also in engagement with the core, the insert comprising means for reducing acoustic noise as the relay contacts engage.

12. The electromagnetic relay of claim 11 wherein the insert is attached to the armature.

13. The electromagnetic relay of claim 12 wherein the insert and the armature engage opposite edges of the core.

14. The electromagnetic relay of claim 13 wherein the armature is tilted relative to the core when the armature engages the core.

15. The electromagnetic relay of claim 11 wherein the insert engages the core prior to engagement of the armature and the core.

16. The electromagnetic relay of claim 11 wherein the insert comprises a molded member.

17. The electromagnetic relay of claim 16 wherein the insert comprises a rubber member.

18. The electromagnetic relay of claim 11 wherein the relay contacts engage prior to engagement of the armature with the core.

19. The electromagnetic relay of claim 18 wherein one of the relay contacts is mounted on the spring and the spring is attached to the armature, wherein the armature is arranged such that overtravel of the armature occurs after the relay contacts engage, resulting in flexure of the spring to increase the contact force between the relay contacts, and wherein the insert is positioned so as to permit said overtravel.

20. An electromagnetic relay comprising:

a magnetic subassembly including a coil surrounding a core;

an armature;

a contact movable upon the application of a magnetic force when an electrical current in the coil attracts the armature into engagement with the core;

a spring biasing the armature so that the contact moves in an opposite direction upon separation of the armature from the core when the electrical current in the coil dissipates resulting in dissipation of the magnetic force;

wherein a nonmagnetic insert located on one of the armature and the magnetic subassembly is in engagement with both the magnetic subassembly and the armature when the magnetic force attracts the armature also into engagement with the core with the armature inclined relative to the core.

* * * * *